US005149044A

United States Patent [19]

Mennekes et al.

[11] Patent Number: 5,149,044

[45] Date of Patent: Sep. 22, 1992

[54] CAP SHOE

[75] Inventors: Werner Mennekes, Lünen; Rudi Podjadtke, Herne, both of Fed. Rep. of Germany

[73] Assignee: Bochumer Eisenhutte Heintzmann GmbH & Co. KG, Bochum, Fed. Rep. of Germany

[21] Appl. No.: 723,490

[22] Filed: Jun. 28, 1991

[30] Foreign Application Priority Data

May 17, 1991 [DE] Fed. Rep. of Germany ..... 4116142

[51] Int. Cl.[5] ..... E21D 15/00

[52] U.S. Cl. ..... 248/357; 405/288

[58] Field of Search ..... 248/351, 357; 405/288

[56] References Cited

U.S. PATENT DOCUMENTS 3,317,173 5/1967 Williams ..... 248/351

FOREIGN PATENT DOCUMENTS 839337 5/1952 Fed. Rep. of Germany ..... 248/357
1009140 5/1957 Fed. Rep. of Germany ..... 248/357
998305 1/1952 France ..... 248/357

*Primary Examiner*—Alvin C. Chin-Shue
*Attorney, Agent, or Firm*—Herbert Dubno

[57] ABSTRACT

A cap shoe for connecting a mine prop to a head tree or cap in the form of a U-shaped girder whose U shanks have corrugations extending the full width thereof is engageable by complementary formations on the flanges of the cap or head tree which is received in the shoe. The latter is welded to the mine prop.

6 Claims, 3 Drawing Sheets

CAP SHOE

FIELD OF THE INVENTION

Our present invention relates to a cap shoe and, more particularly, to a connector between a cap tree, bar, beam, runner, girder or head of a timbering system for use in mines. More particularly, the invention relates to a cap shoe forming a connection between the head tree and a mine prop and in which a form-fitting connection is provided between the cap shoe and the head tree.

BACKGROUND OF THE INVENTION

In the timbering or roof support of mines, it is a common practice to provide mine prop which support head trees at the upper ends of the mine props. The head trees can constitute girders which are connected to the upper ends of the mine props by so-called cap shoes, also referred to as cap knees, bar shoes, jointing shoes and with other similar terminology. A cap, therefore, is a head tree or girder, also referred to as a bar, beam, runner, head block, roof bar, running bar or roof timber.

In the past, the caps have generally been girders with a structural shape profile, e.g. a I beam or an H beam, whose flanged surfaces are provided with recesses or with knoppy formations which can be engaged by the cap shoes.

Caps with knoppy I beam or H beam structural shapes are utilized in mines, for example, as timbering sets in mine galleries and as supports or bracing in long wall/gallery transitions as well as for additional bracing in arched galleries and the like. The mine props which can be used are generally hydraulic ram props or two-part friction props on whose prop ends the cap shoe can be affixed by welding.

The cap shoe which constitutes the starting point for the present invention is a drop-forged part constructed in accordance with German Industrial Standard DIN 21 561 with a massive base plate and four cylindrical rises at the corners of this base plate and which engage in recesses of the knoppy cap form-fittingly. This eliminates the possibility of shifting of the cap relative to the props.

To ensure sufficient stiffness, the prior art cap shoe must be formed as a massive heavy body, utilizing large amounts of material so that the cost of the cap shoe is high and the cap shoe may be difficult to assemble with the prop.

OBJECTS OF THE INVENTION

It is, therefore, the principal object of the present invention, to provide an improved cap shoe which makes use of a reduced amount of material but yet has sufficient shape stability and can ensure a reliable connection between the cap and the mine prop.

Another object of this invention is to provide a cap shoe which is free from the drawbacks of the prior art cap shoe described above.

It is also an object of the invention to provide an improved mine support assembly utilizing mine props, cap shoes and a head tree or cap.

SUMMARY OF THE INVENTION

These objects and others which will become apparent hereinafter are attained, in accordance with the invention, by providing the cap shoe as a U-shaped member or girder having shanks of the U-shaped girder formed with inwardly projecting corrugations which constitute formfitting elements for engagement with the cap or head tree.

Preferably these corrugations extend over the full width of the shanks of the structural shapes forming the girder and, in an optimum configuration, each of the shanks is provided with at least two such corrugations and the corrugations are parallel to one another and so oriented that the corrugations of one shank lie directly opposite the inwardly projecting corrugations of the other shank. The U-shaped girder with the corrugations formed in the shanks thereof can be a die-shaped part, e.g. a forging or stamping. The stress distribution does not have any discontinuities and thus the die-shaped part has an especially high strength. It has been found to be advantageous, however, to form the shank of the U-shaped girder with bores adapted to receive screws or bolts for attachment of the cap to the shoe.

The cap shoe according to the invention can connect a head tree of a mine support to a mine prop, the cap shoe being formed as a U-shaped elongated member having a base plate adapted to be affixed to the mine prop and a pair of generally parallel spaced-apart shanks extending orthogonally to the base plate and formed with inwardly projecting, longitudinally spaced corrugations elongated in directions perpendicular to the base plate and formfittingly engageable in complementary formations of the head tree.

The overall assembly can comprise:

a mine prop having an end;

a cap tree supported by the mine prop; and a cap shoe connecting the cap tree with the end of the mine prop, the cap shoe being formed as a U-shaped elongated member having a base plate adapted to be affixed to the mine prop and a pair of generally parallel spaced-apart shanks extending orthogonally to the base plate and formed with inwardly projecting, longitudinally spaced corrugations elongated in directions perpendicular to the base plate and formfittingly engageable in complementary formations of the head tree.

For the same shape stability as the prior art cap shoe fabricated in accordance with DIN 21 561, we can make a cap shoe that has 30% less weight. The die shaping is a simple and inexpensive fabrication method. A further advantage of the cap shoe of the invention is that the form-locking elements constituted by the corrugations allow a fairly wide rang of angles between the mine prop and the head tree without causing problems with respect to slip or shifting.

The use of additional screw connections between cap and cap shoe can further improve the connection. Finally, the system of the invention permits rapid, reliable and simple assembly of the mine support.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1A:
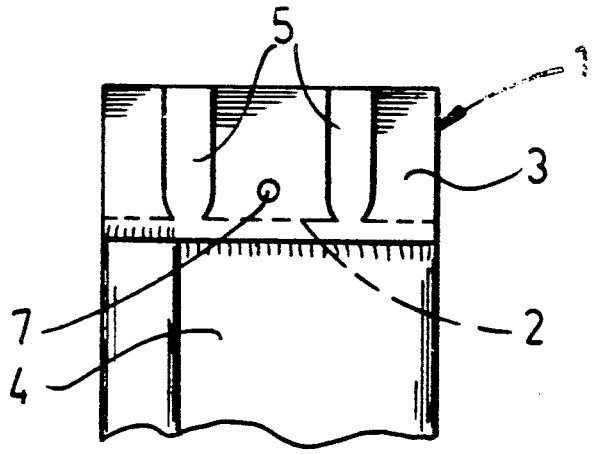
FIGS. 1*a*–1*c* are respectively a side elevational view, a front view and a plan view of an end of a mine prop to which a cap shoe of the invention has been welded.
Figure 1B:
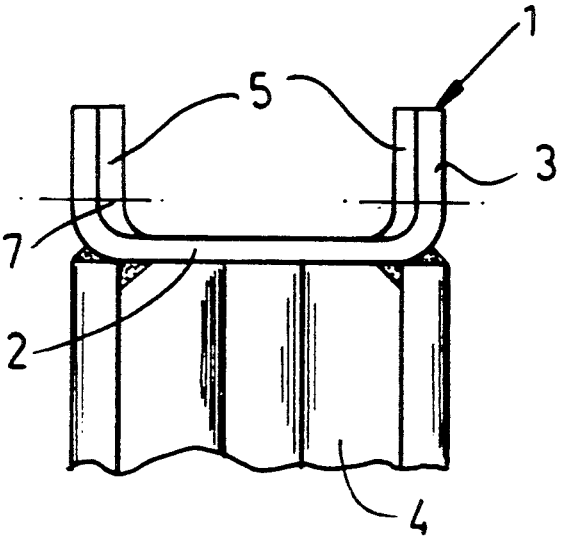
Figure 1C:
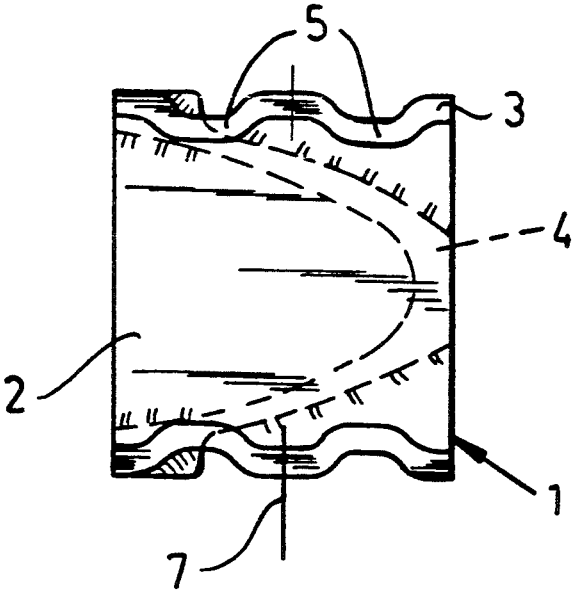

As can be seen for the cap shoe of FIGS. 1*a*–1*c*, the cap shoe comprises a U-shaped girder 1 formed with a base plate 2 and shanks 3 extending orthogonally from the base plate and formed unitarily therewith.

The base plate 2 is welded onto the ram end of the mining prop 4.

In the shanks of the U-shaped girder 1 inwardly projecting corrugations 5 are formed, these corrugations constituting connecting elements for a cap or head tree 6. The corrugations 5 are orthogonal to the upper side of the base plate 2 and extend substantially the full width of the shank 3.

The term "orthogonal" is used here to signify that the shanks 3 and the corrugations 5 include right angles with the upper surface of the base plate.

Figure 2A:
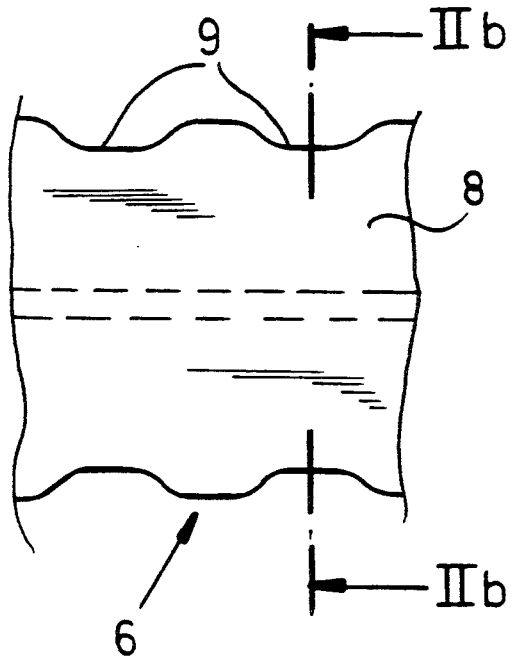
FIG. 2*a* is a plan view of the head tree or cap which is to be used with the cap shoe of FIGS. 1*a*–1*c*.
Figure 2B:
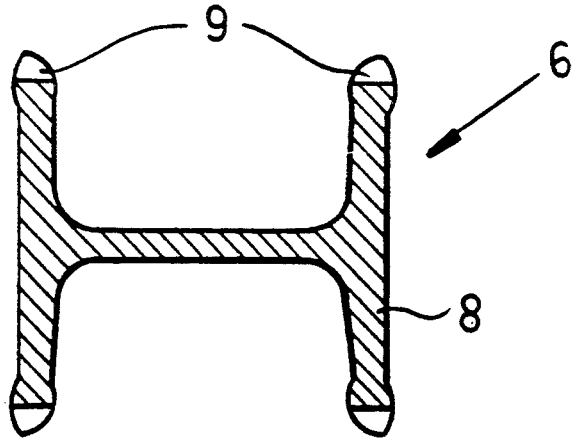
FIG. 2*b* is a section taken along the line II*b*—II*b* of FIG. 2*a*.

From FIGS. 1*b* and 1*c*, it can be readily seen that each of the shanks 3 has two parallel corrugations 5 and that the corrugations of the two shanks are substantially opposite one another. In the region of the shanks 3, bores 7 can be provided for securing the cap shoe to the cap or head tree by connecting screws. The cap shoe can be formed by a die pressing or stamping operation. The cap 6 engageable in the cap shoe, is a knoppy I beam, H beam or similar structural shape as has been illustrated in FIGS. 2*a* and 2*b*. Such shapes include the double T shape shown in FIGS. 2*a* and 2*b*, whose flange surfaces 8 at uniform distances from one another can be provided with edge recesses complementary to the corrugations.

Figure 3A:
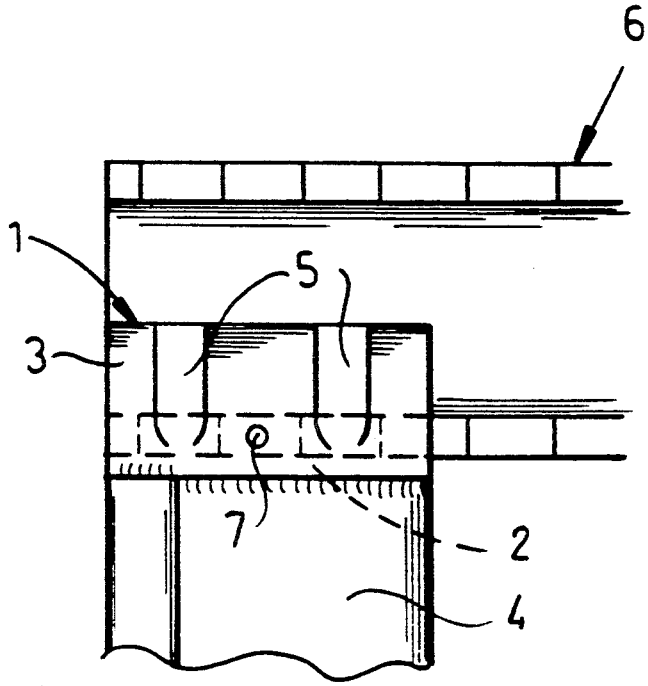
FIGS. 3*a* and 3*b* are a side view and a plan view, respectively, of a cap shoe showing the connection between the mine prop and the cap or head tree.
Figure 3B:
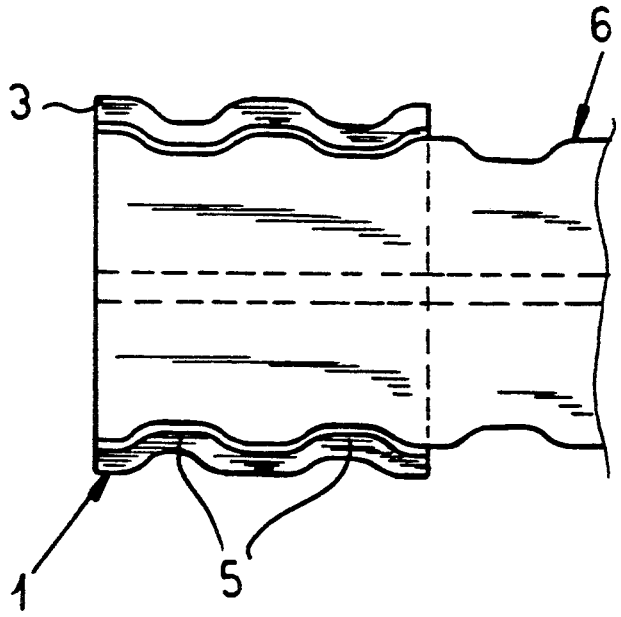

The dimensions of the peripheral recesses as well as of the spacing a thereof can be chosen for the particular cap shoe. The connection between cap shoe 1 and cap 6 has been shown in FIG. 3*a* and FIG. 3*b*. The corrugations 5 engage in the recesses 9 of the cap 6 and the cap 6 is thereby secured against movement relative to the mine prop 4.

We claim:

1. A mine support assembly, comprising:

a mine prop having an end;

a cap tree supported by the mine prop; and a cap shoe connecting said cap tree with said end of said mine prop, said cap shoe being formed as a die-shaped U-shaped elongated member having a base plate adapted to be affixed to said mine prop and a pair of generally parallel spaced-apart shanks extending orthogonally to said base plate all along the base plate and unitary therewith, said shanks being formed with inwardly projecting, longitudinally spaced corrugations elongated in directions perpendicular to said base plate and formfittingly engageable in complementary formations of said head tree.

2. The mine support assembly defined in claim 1 wherein said corrugations extend substantially a full width of the respective shank.

3. The mine support assembly defined in claim 1 wherein each of said shanks is formed with at least two inwardly projecting corrugations and the corrugations of both shanks are disposed directly opposite one another and parallel to one another.

4. The mine support assembly defined in claim 1 wherein said shanks are formed with bores for receiving screws affixing said cap tree to the member.

5. The mine support assembly defined in claim 4 wherein said corrugations extend substantially a full width of the respective shank.

6. The mine support assembly defined in claim 5 wherein each of said shanks is formed with at least two inwardly projecting corrugations and the corrugations of both shanks are disposed directly opposite one another and parallel to one another.

* * * * *